US009533517B2

(12) United States Patent
Ito et al.

(10) Patent No.: US 9,533,517 B2
(45) Date of Patent: Jan. 3, 2017

(54) INK-JET RECORDING APPARATUS

(71) Applicant: Brother Kogyo Kabushiki Kaisha, Nagoya-shi, Aichi-ken (JP)

(72) Inventors: Tsuyoshi Ito, Nagoya (JP); Kenji Samoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/054,359

(22) Filed: Feb. 26, 2016

(65) Prior Publication Data

US 2016/0250870 A1 Sep. 1, 2016

(30) Foreign Application Priority Data

Feb. 27, 2015 (JP) ..... 2015-039180

(51) Int. Cl.
*B41J 13/03* (2006.01)

(52) U.S. Cl.
CPC ..... *B41J 13/03* (2013.01)

(58) Field of Classification Search
CPC ..... B41J 13/03; B41J 15/04; B41J 15/08; B41J 15/10; B41J 15/12
See application file for complete search history.

(56) References Cited

U.S. PATENT DOCUMENTS 6,008,824 A * 12/1999 Nitta ..... B41J 13/103 346/134
2005/0195242 A1* 9/2005 Samoto ..... B41J 19/00 347/37
2006/0139430 A1* 6/2006 Izuchi ..... B41J 13/076 347/104
2008/0014006 A1* 1/2008 Takeuchi ..... B41J 13/076 400/625
2008/0239046 A1* 10/2008 Shiohara ..... B41J 11/0045 347/104
2008/0298821 A1* 12/2008 Mori ..... B41J 3/60 399/21
2011/0310206 A1* 12/2011 Samoto ..... B41J 13/0018 347/104

FOREIGN PATENT DOCUMENTS

JP 2000-071532 A 3/2000

* cited by examiner

*Primary Examiner* — Stephen Meier
*Assistant Examiner* — Alexander D Shenderov
(74) *Attorney, Agent, or Firm* — Banner & Witcoff, Ltd.

(57) ABSTRACT

An ink-jet recording apparatus includes: a conveyance roller pair which conveys a sheet in a conveyance direction; a recording section having a nozzle surface provided with nozzles and which jets ink droplets from the nozzles thereby recording an image on the sheet conveyed by the conveyance roller pair; a platen arranged to face the recording section; a first support frame which supports the recording section; a first contact member supported by the first support frame, arranged upstream of the nozzles in the conveyance direction, extended toward the platen, and which contacts with the sheet; a discharge roller arranged downstream of the nozzles in the conveyance direction; a second support frame which supports the discharge roller; and a spur arranged to face the discharge roller and which contacts with the sheet from the same direction as the first contact member.

10 Claims, 9 Drawing Sheets

INK-JET RECORDING APPARATUS

CROSS REFERENCE TO RELATED APPLICATION

The present application claims priority from Japanese Patent Application No. 2015-039180, filed on Feb. 27, 2015, the disclosure of which is incorporated herein by reference in its entirety.

FIELD OF THE INVENTION

The present teaching relates to ink-jet recording apparatuses jetting ink droplets from nozzles to record an image on a sheet.

DESCRIPTION OF THE RELATED ART

Conventionally, there are known ink-jet recording apparatuses jetting ink droplets from nozzles to record an image on a sheet. In such ink-jet recording apparatuses, when a recording section jets the ink droplets on the sheet such as paper or the like, the sheet permeated with the ink is deformed to warp. Due to the deformation of the sheet, there is such a problem that the sheet contacts with the recording head and/or the anterior end of the sheet fails to be guided to a nip position of a roller pair. In order to address this problem, it is contrived to cause the sheet conveyed onto the platen to come into a wavy or ruffled state in a width direction orthogonal to a conveyance direction.

SUMMARY

In order to reliably cause the sheet to come into the wavy state, it is desirable to provide a mechanism (concave-convex shaping portions) which causes the sheet to come into the wavy state on both the upstream and the downstream of the recording section in the conveyance direction. However, if the concave-convex shaping portion upstream of the recording section deviates in position in the conveyance direction from the concave-convex shaping portion downstream of the recording section, then such a problem will arise that misalignment (twist) occurs in the wavy state of the sheet and/or the distance (head gap) between the sheet and the nozzle surface of the recording section becomes unstable, thereby degrading the precision in recording the image.

The present teaching is made in view of the situation mentioned above, and an object thereof is to provide an ink-jet recording apparatus capable of raising the precision of wavy state of the sheet on upstream and downstream of the recording section in the conveyance direction.

According to an aspect of the present teaching, there is provided an ink-jet recording apparatus including: a conveyance roller pair configured to convey a sheet guided through a conveyance path in a conveyance direction; a recording section having a nozzle surface provided with nozzles and configured to jet ink droplets from the nozzles and to record an image on the sheet conveyed by the conveyance roller pair; a platen arranged to face the recording section; a first support frame configured to support the recording section; a first contact member supported by the first support frame, arranged upstream of the nozzles in the conveyance direction, extended toward the platen, and configured to contact with the sheet; a discharge roller arranged downstream of the nozzles in the conveyance direction; a second support frame configured to support the discharge roller; and a spur arranged to face the discharge roller and configured to contact with the sheet from the same direction as the first contact member, wherein the first support frame is supported by the second support frame, and a contact part, at which the first contact member contacts with the sheet, and a nip position, at which the discharge roller and the spur nip the sheet, are located at the same position in a width direction intersecting the conveyance direction and being parallel to the nozzle surface, and have the same shortest distance from a virtual surface including the nozzle surface.

On the upstream side of the recording section in the conveyance direction, the first contact member is in contact with the sheet being conveyed on the platen. On the downstream side of the recording section in the conveyance direction, the discharge roller and the spur nip the sheet being conveyed on the platen. The contact part at which the first contact member contacts with the sheet and the nip position at which the discharge roller and the spur nip the sheet are located at the same position in the width direction, and have the same shortest distance from the virtual surface including the nozzle surface. Therefore, a distance between the sheet on the platen and the nozzle surface is stabilized in the conveyance direction. Further, "the same" not only means that the two shortest distances are completely the same but also means to include such a state that the two shortest distances are included in a predetermined range where the present teaching fulfills its function and exerts its effect.

The first contact member is supported by the first support frame and the discharge roller is supported by the second support frame. Further, the first support frame is also supported by the second support frame. Therefore, it is possible to realize an accurate positioning between the contact part of the first contact member and the nip position defined by the discharge roller and the spur.

DESCRIPTION OF THE EMBODIMENT

Referring to the accompanying drawings as appropriate, an embodiment of the present teaching will be explained below. Further, it is needless to say that the embodiment explained below is merely one example of the present teaching and it is possible to appropriately change the embodiment of the present teaching without departing from the true spirit and scope of the present teaching. In the following explanation, an up-down direction 7, a front-rear direction 8, and a left-right direction 9 (to be referred to below as "width direction 9") are defined with reference to a multifunction peripheral 10 placed in a usable state as depicted in FIG. 1.

<Overall Configuration of the Multifunction Peripheral>

Figure 1:
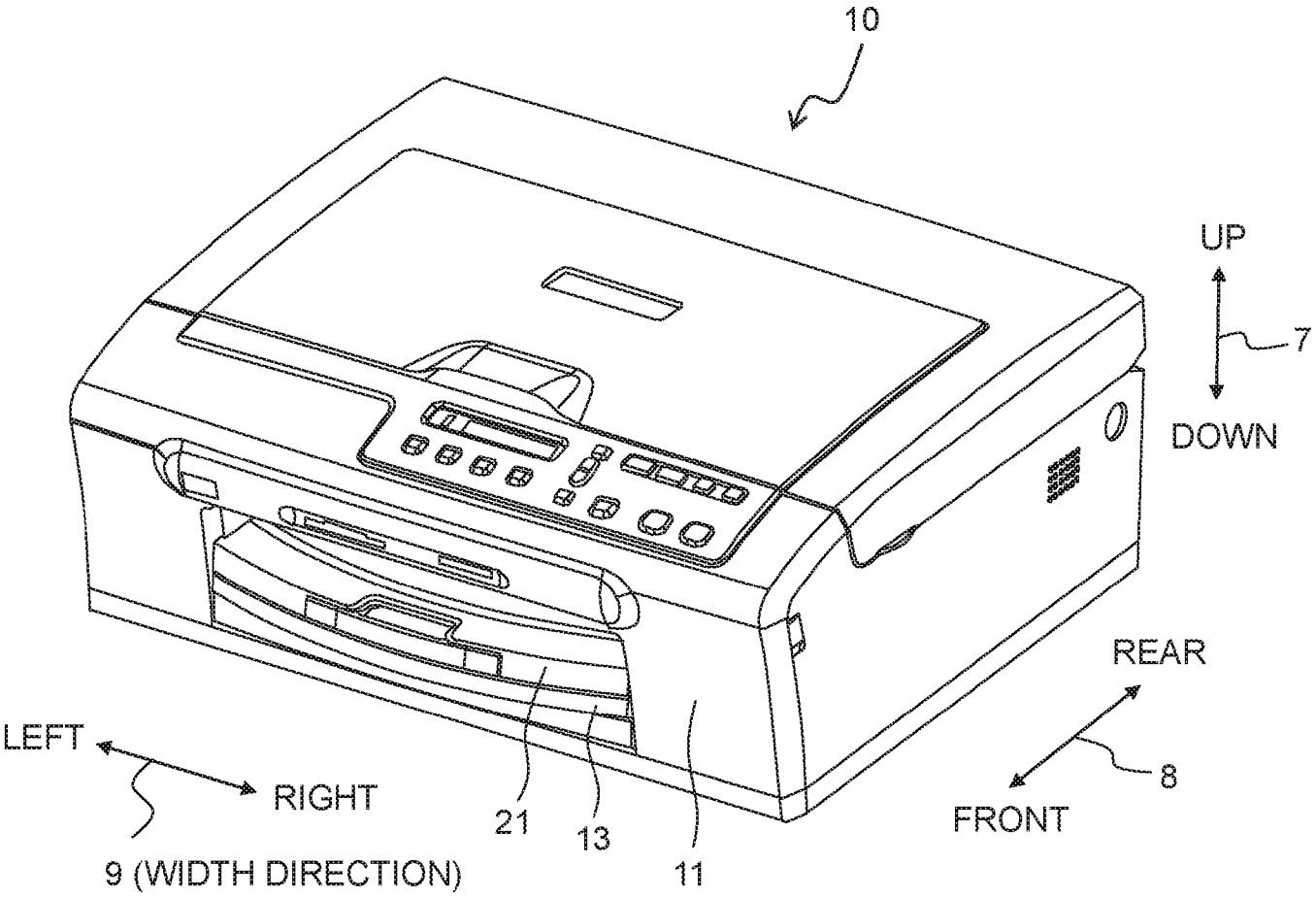
FIG. 1 is a perspective view of a multifunction peripheral as one example of an embodiment of the present teaching.

The multifunction peripheral 10 (one example of the "ink-jet recording apparatus") depicted in FIG. 1 has various functions such as a printer function, a facsimile function, a photocopy function, and the like. The multifunction peripheral 10 has an apparatus body 11 formed approximately in a low-profile cuboidal shape, and a feeding tray 13 insertable to and removable from a lower portion of the apparatus body 11. If the feeding tray 13 is drawn out frontward from the state of being installed in the apparatus body 11 as depicted in FIG. 1, then the feeding tray 13 is removed from the apparatus body 11.

Figure 2:
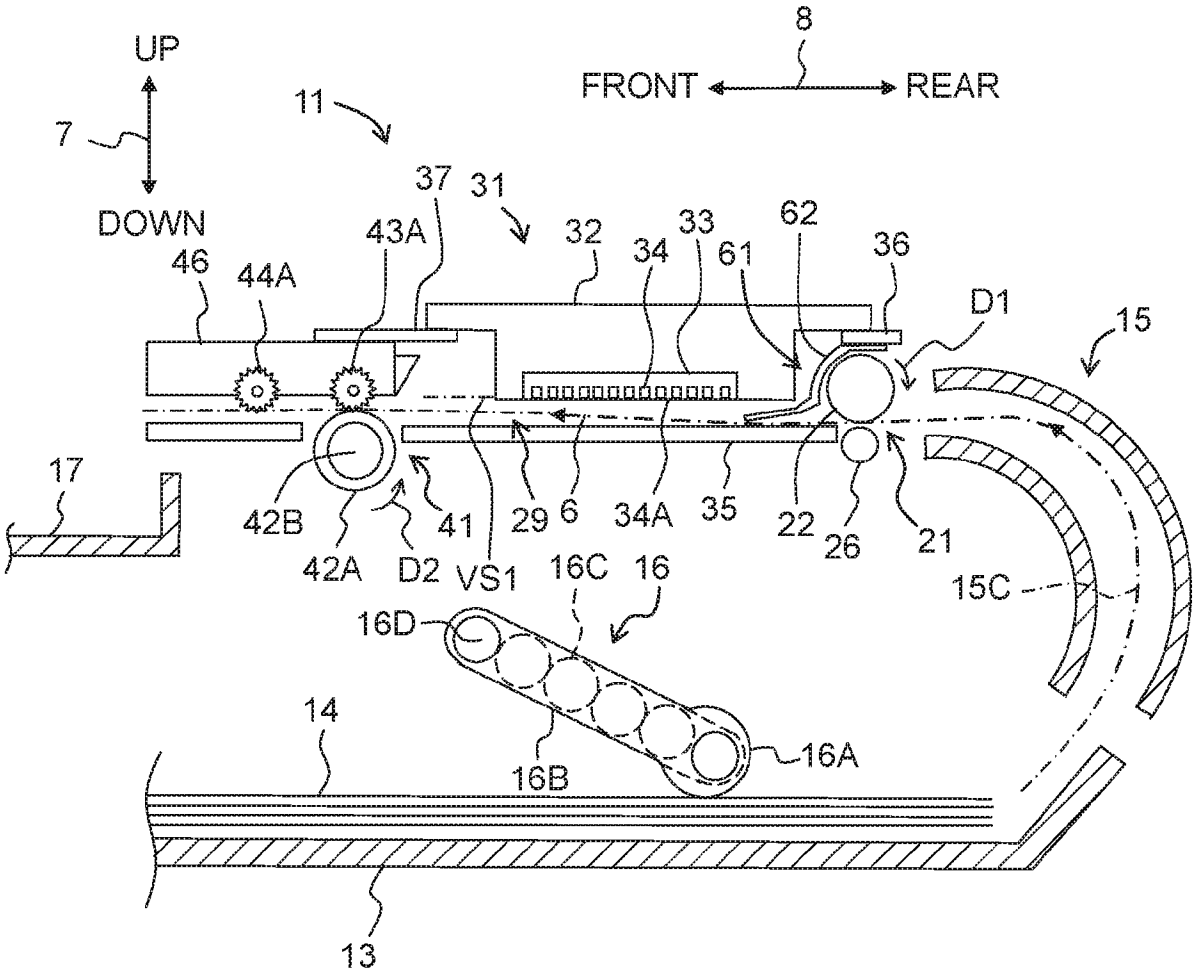
FIG. 2 is a schematic diagram depicting a configuration of the multifunction peripheral.

As depicted in FIG. 2, in an upper portion inside the apparatus body 11, a recording section 31 is provided to record image on recording media. The feeding tray 13 installed in the apparatus body 11 is positioned below the recording section 31 and is capable of loading a plurality of sheets as the recording media being stacked vertically. In this embodiment, the feeding tray 13 is loaded internally with recording paper 14 as the sheets which are A4 size plain paper whose longitudinal direction is along the front-rear direction 8. Further, the size and the like of the recording paper 14 loaded on the feeding tray 13 are merely one example, and thus it is possible to use other sizes and/or other sheets than plain paper.

The apparatus body 11 is provided internally with a feeding portion 16 to convey rearward the uppermost one sheet of the recording paper 14 loaded internally on the feeding tray 13, and a feeding guide member 15 to guide upward the recording paper 14 conveyed rearward from the feeding tray 13. The feeding guide member 15 is arranged in a position close to the back side in the apparatus body 11.

The feeding portion 16 has a feed roller 16A extending along the width direction 9, and a support arm 16B supporting the feed roller 16A to be movable in the up-down direction 7. The support arm 16B is supported to be revolvable on a support shaft 16D extending along the width direction 9 while the feed roller 16A is supported to be rotatable on a leading end portion of the support arm 16B. If the support arm 16B revolves about the support shaft 16D in the up-down direction 7, then the feed roller 16A moves between a position in contact with the uppermost sheet of the recording paper 14 in the feeding tray 13 and a position upwardly away from that sheet of the recording paper 14. The feed roller 16A is caused to rotate by receiving a drive force transmitted from an unshown motor via a drive force transmission mechanism 16C.

If the feed roller 16A is rotated while in contact with the uppermost sheet of the recording paper 14 loaded internally on the feeding tray 13, then that sheet of the recording paper 14 is fed rearward. The recording paper 14 fed from the feeding tray 13 is conveyed to a lower end portion of the feeding guide member 15.

The feeding guide member 15 is provided with a feeding path 15C through which the recording paper 14 passes. The feeding path 15C is formed in an arc-like shape to project toward the back side of the apparatus body 11. The recording paper 14 guided by the feeding guide member 15 is conveyed frontward from an upper end portion of the feeding guide member 15.

Further, the recording paper 14 in the feeding tray 13 is conveyed with its central portion in the width direction 9 moving along a central portion of the feeding path 15C in the width direction 9 (based on a center reference). Further, the multifunction peripheral 10 is not limited to using the recording paper 14 of A4 size but is also capable of feeding recording paper of smaller size such as postcards (more rigid than plain paper), for example, in the feeding path 15C along the guide center. Further, the postcards are merely one example of small size sheets, and sheets of L (large) size and the like may also be used.

A conveyance roller pair 21 is provided in a frontal position close to the upper end portion of the feeding guide member 15, to convey the recording paper 14 passing through the upper end portion of the feeding guide member 15, to some place below the recording section 31. A platen 35 is provided to support the recording paper 14 below the recording section 31, in front of the conveyance roller pair 21, that is, on the downstream side in the orientation for the conveyance roller pair 21 to convey the recording paper 14 (to be referred to below as a sheet conveyance direction 6; see FIG. 2). On the upstream and downstream sides in the sheet conveyance direction 6 with respect to a recording head 33 provided in a lower portion of the recording section 31, an upstream wavy shape applying mechanism 61 and a downstream wavy shape applying mechanism 41 are provided respectively to apply a wavy or ruffled shape along the width direction 9 to the recording paper 14.

The conveyance roller pair 21 has one conveyance roller 22 to contact with the upper surface (the first surface) of the recording paper 14 having passed through the feeding guide member 15, and a plurality of pinch rollers 26 to contact with the lower surface (the second surface) of the recording paper 14. The recording paper 14 having passed through the feeding guide member 15 is nipped by the rotating conveyance roller 22 and pinch rollers 26 and conveyed through a conveyance path 29 formed between the platen 35 and the recording section 31. The conveyance path 29 extends up to a paper discharge tray 17 via the downstream wavy shape applying mechanism 41.

The recording section 31 provided above the platen 35 is supported by a first guide frame 36 (one example of the "first support frame") and a second guide frame 37 which are arranged respectively along the width direction 9 orthogonal to the sheet conveyance direction 6. The first guide frame 36 and the second guide frame 37 are supported in a parallel fashion at a certain interval in the sheet conveyance direction 6.

The recording section 31 has a carriage 32 provided to be slidable in the width direction 9 between the first guide frame 36 and the second guide frame 37. The recording head 33 is provided in a lower portion of the carriage 32.

The recording head 33 includes a plurality of nozzles 34 to jet ink downward. Each of the nozzles 34 is supplied with the ink from an ink cartridge (not depicted). The plurality of nozzles 34 are arranged in rows along the sheet conveyance direction 6, and are open at a nozzle surface 34A which is the lower surface of the recording head 33. The nozzle surface 34A is a flat surface along the sheet conveyance direction 6 and the width direction 9. Further, in this embodiment, the nozzle surface 34A is horizontal.

The platen 35 provided below the recording section 31 supports the recording paper 14 being conveyed by the conveyance roller pair 21. If the conveyance roller pair 21 conveys the recording paper 14 to reach a predetermined position on the platen 35, then conveyance of the recording paper 14 is stopped.

If the recording paper 14 stands still on the platen 35, then the recording section 31 carries out a recording process to selectively jet the ink from the nozzles 34 of the recording head 33 while the carriage 32 is sliding in the width direction 9 orthogonal to the sheet conveyance direction 6. Thereafter, by repetitively carrying out the above recording process and a conveyance process for the conveyance roller pair 21 to convey the recording paper 14 on the platen 35 by a predetermined distance, image is recorded on the entire recording paper 14.

The downstream wavy shape applying mechanism 41 provided downstream from the recording head 33 in the sheet conveyance direction 6 conveys the recording paper 14 supported on the platen 35 in the sheet conveyance direction 6 while applying the wavy or ruffled shape along the width direction 9 to the recording paper 14 on the platen 35.

The downstream wavy shape applying mechanism 41 has a plurality of discharge rollers 42A to contact with the lower surface (the second surface) of the recording paper 14 with the image recorded by the recording section 31, and a plurality of first spurs 43A and a plurality of second spurs 44A to contact with the upper surface (the first surface) of the recording paper 14 from above. The plurality of discharge rollers 42A are arranged to be separate from each other in the width direction 9, while the plurality of first spurs 43A are arranged respectively above the plurality of discharge rollers 42A. The first spurs 43A are supported by a spur support member 46. One single discharge roller shaft 42B is inserted through a shaft center portion of each of the discharge rollers 42A.

The recording paper 14 is nipped by the discharge rollers 42A and the first spurs 43A and thus made wavy or ruffled along the width direction 9 while being conveyed downstream in the sheet conveyance direction 6. The plurality of second spurs 44A are in contact with the upper surface of the recording paper 14 being conveyed by the discharge rollers 42A and the first spurs 43A. Thereafter, the recording paper 14 is discharged onto the paper discharge tray 17.

<Conveyance Roller Pair>

Figure 6A:
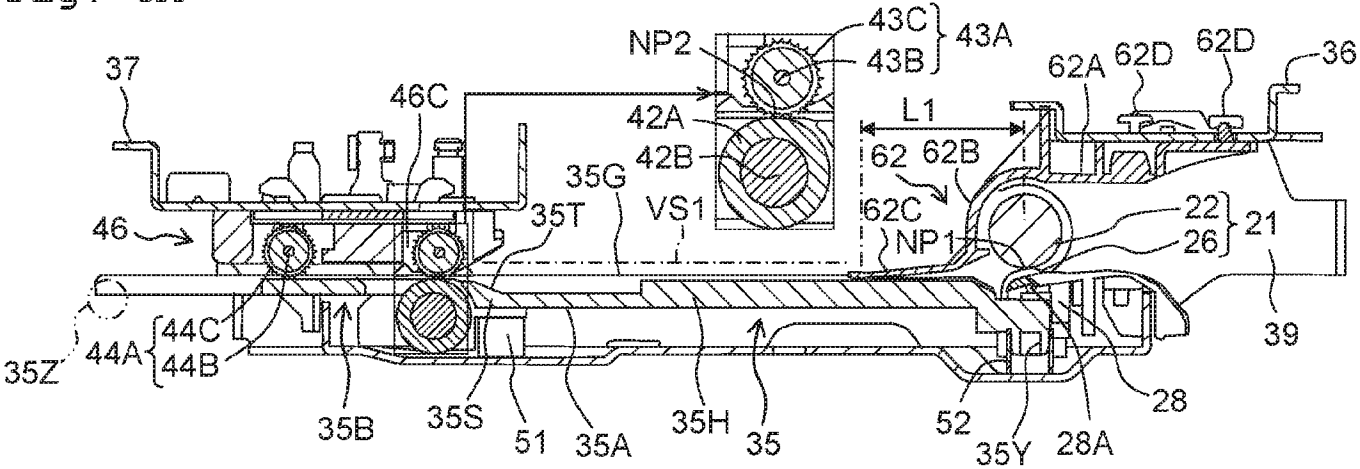
FIG. 6A is a cross-sectional view along a line VIA-VIA of FIG. 3.

As depicted in FIG. 6A, the conveyance roller 22 of the conveyance roller pair 21 is supported by a sub-frame 39 (one example of the "second support frame") respectively supporting two opposite end portions of the first guide frame 36 in the width direction 9. Further, while not depicted in FIG. 6A, the sub-frame 39 also respectively supports two opposite end portions of the second guide frame 37 in the width direction 9. The rotation of an unshown motor is transmitted to the conveyance roller 22 which is thus rotated in an orientation depicted with the arrow D1 of FIG. 2.

Figure 7A:
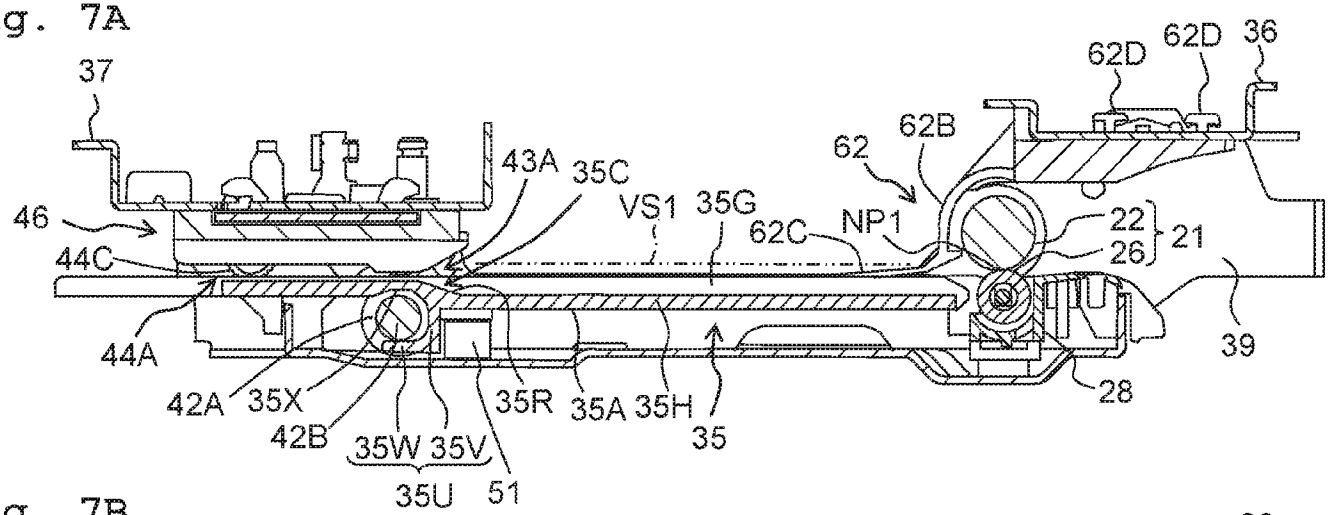
FIG. 7A is a cross-sectional view along a line VIIA-VIIA of FIG. 3.

As depicted in FIG. 7A, the plurality of pinch rollers 26 are provided under the conveyance roller 22, and supported by a roller holder 28 to separate each other at an interval in the width direction 9. The roller holder 28 is movable such that the respective pinch rollers 26 may change from its state of contact with the conveyance roller 22 to that of separation from the conveyance roller 22. The respective pinch rollers 26 in contact with the conveyance roller 22 are rotated by following the rotation of the conveyance roller 22.

The conveyance roller 22 is in contact with the respective pinch rollers 26 at a nip position NP1 to nip the recording paper 14 being conveyed. The recording paper 14 nipped at the nip position NP1 is conveyed downstream in the sheet conveyance direction 6 by the rotations of the conveyance roller 22 and the pinch rollers 26.

<Upstream Wavy Shape Applying Mechanism>

Figure 3:
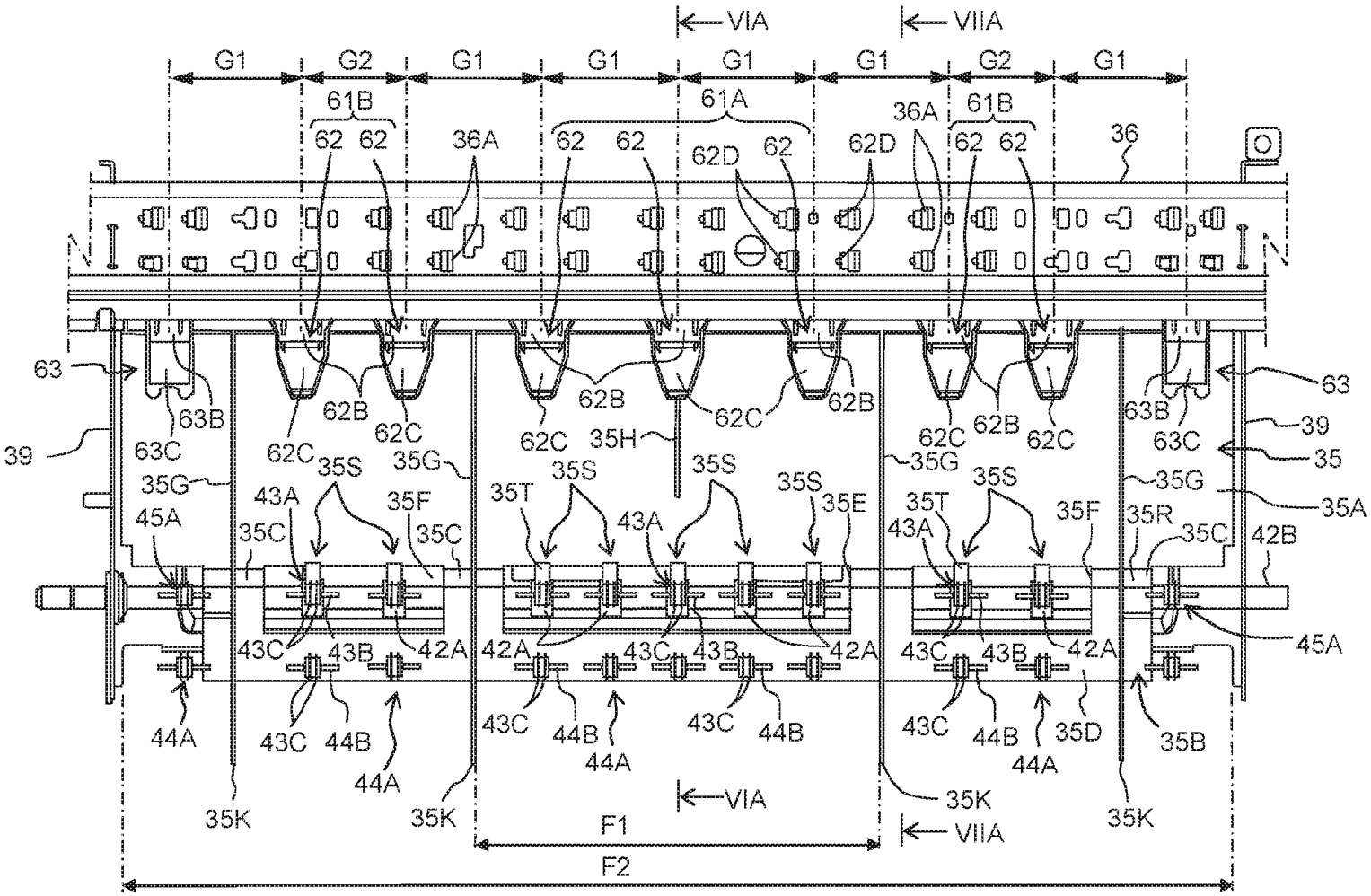
FIG. 3 is a plan view of a first guide frame and a platen.
Figure 4:
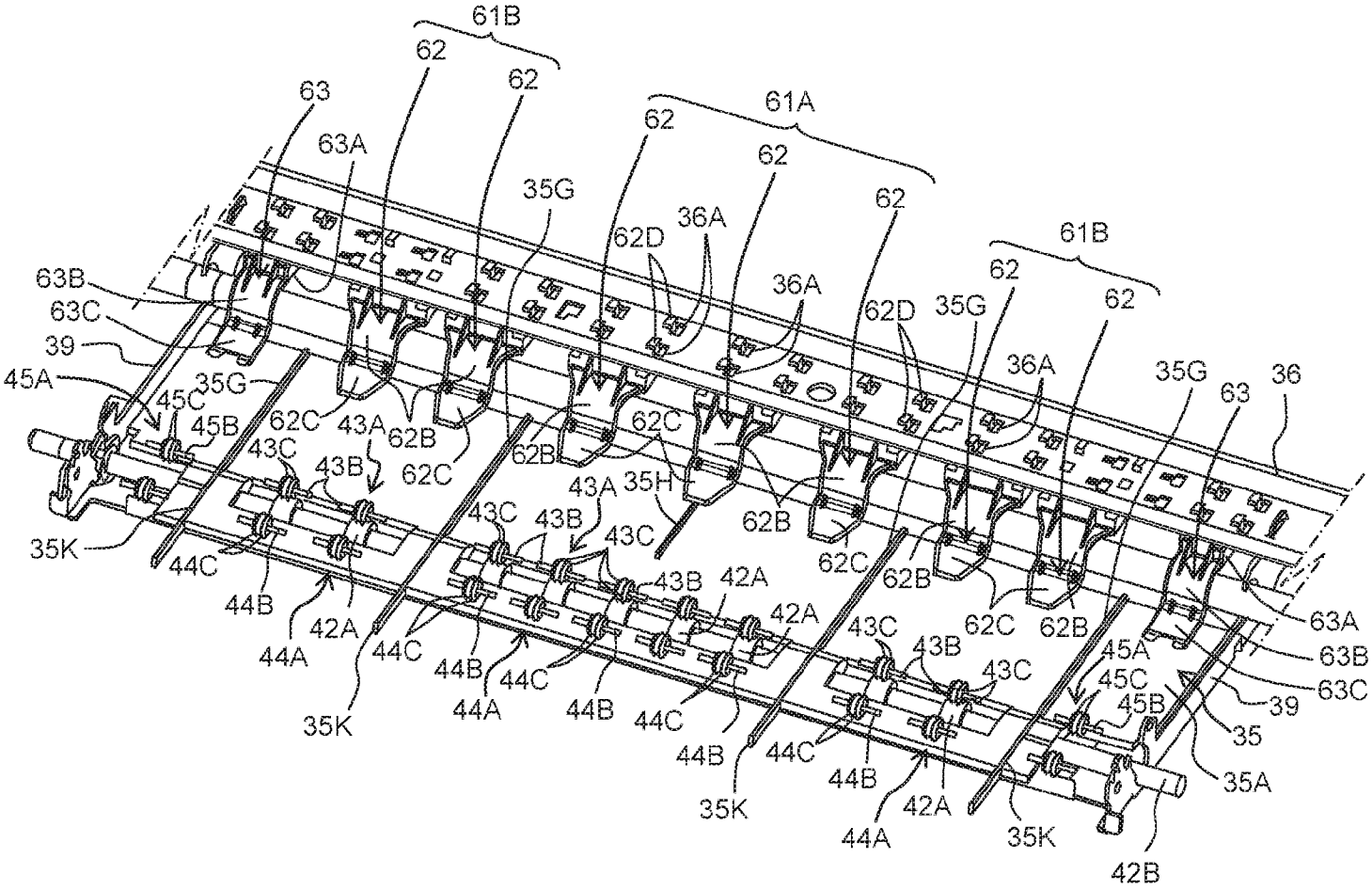
FIG. 4 is a perspective view from a downstream side in a sheet conveyance direction of FIG. 3.

As depicted in FIGS. 3 and 4, the upstream wavy shape applying mechanism 61 has seven upstream contact members 62 (one example of the "first contact member") fitted on the lower surface of the first guide frame 36, and end portion contact members 63 provided respectively on two end positions of the upstream wavy shape applying mechanism 61 in the width direction 9.

As depicted in FIG. 4, a central wavy shape applying portion 61A is composed of the three upstream contact members 62 positioned in a central portion in the width direction 9, while one set of lateral wavy shape applying portions 61B is composed of the two upstream contact members 62 provided on each of the two outer sides of the central wavy shape applying portion 61A in the width direction 9. The central upstream contact member 62 in the central wavy shape applying portion 61A is arranged in a position corresponding to the center of the platen 35 in the width direction 9.

The three upstream contact members 62 constituting the central wavy shape applying portion 61A are arranged at a certain interval G1 therebetween. As will be described later on, these three upstream contact members 62 are provided not to apply a wavy or ruffled shape to any recording paper of small size (such as postcards) having such a length along the width direction 9 as to contact with those three upstream contact members 62 only, but to apply the wavy shape to the recording paper 14 of A4 size.

As depicted in FIG. 3, the two upstream contact members 62 constituting each of the lateral wavy shape applying portions 61B are arranged at a shorter interval G2 than the above G1. An interval (=G1) equal to the above interval G1 is present between the upstream contact member 62 on each of the two ends of the central wavy shape applying portion 61A in the width direction 9, and the upstream contact member 62 close to the central wavy shape applying portion 61A in each of the lateral wavy shape applying portions 61B. Another interval (=G1) equal to the above interval G1 is present between each end portion contact member 63, and the upstream contact member 62 close to that end portion contact member 63 in the corresponding one of the lateral wavy shape applying portions 61B.

Figure 6B:
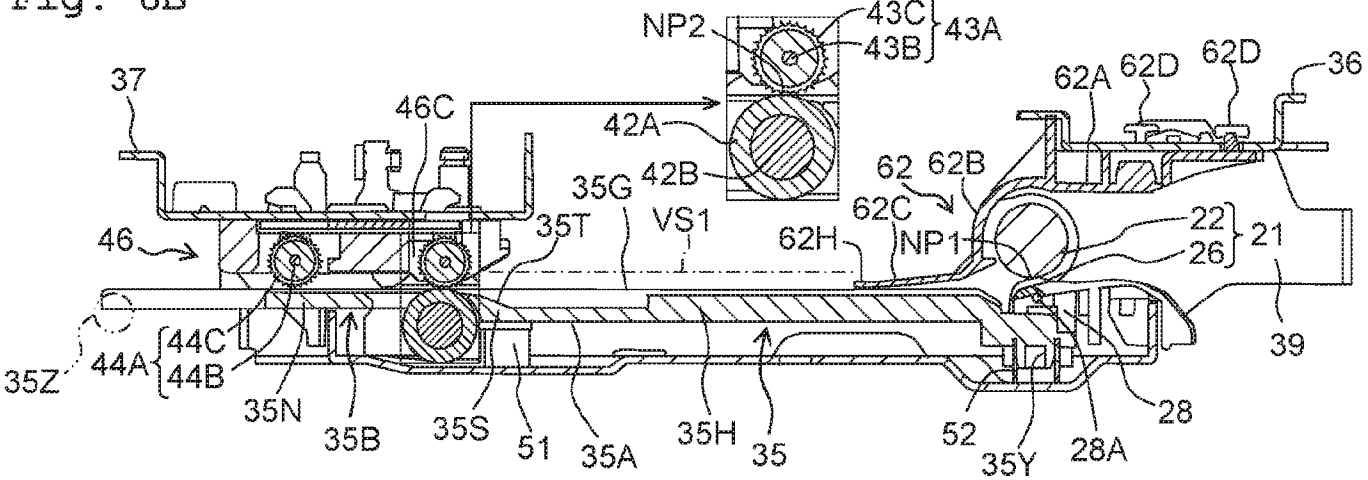
FIG. 6B is an explanatory view of a state of the platen having moved downward in FIG. 6A.

The seven upstream contact members 62 all have the same shape and, as depicted in FIGS. 6A and 6B, each have a base portion 62A fitted on the lower surface of the first guide frame 36, a connection portion 62B hanging from the base portion 62A, and a contact portion 62C provided at the lower end of the connection portion 62B. Each of the upstream contact members 62 is formed integrally of a synthetic resin (polyacetal (POM), for example).

The base portion 62A is positioned below the first guide frame 36, and has a plurality of lock portions 62D locked on the first guide frame 36. The respective lock portions 62D project upward from the base portion 62A. The first guide frame 36 is provided with openings 36A (see FIGS. 3 and 4) for the respective lock portions 62D to be inserted therein.

The connection portion 62B is shaped like a band plate whose length along the width direction 9 is almost constant. Further, as depicted in FIG. 6A, the connection portion 62B is curved to project frontward so as to follow the outer circumferential part of the conveyance roller 22 from the downstream end of the base portion 62A in the sheet conveyance direction 6. The downstream end of the connection portion 62B in the sheet conveyance direction 6 is positioned downstream from and below the base portion 62A in the sheet conveyance direction 6. The connection portion 62B is flexible to be movable in the up-down direction 7.

The contact portion 62C is shaped like a flat plate provided at the lower end of the connection portion 62B, and formed into an triangle, in planar view, whose length along the width direction 9 decreases gradually in the frontward direction. The contact portion 62C is positioned upstream from the nozzles 34 of the recording section 31 in the sheet conveyance direction 6, and extends out toward the platen 35. The contact portion 62C is inclined downstream and downward in the sheet conveyance direction 6. The leading end of the contact portion 62C is positioned downstream in the sheet conveyance direction 6, serving as the contact part to contact with the upper surface of the recording paper 14 from above.

As depicted in FIGS. 6A and 6B, the contact part of the contact portion 62C of the upstream contact member 62 to contact with the upper surface of the recording paper 14 is separate downstream by a distance L1 in the sheet conveyance direction 6 from the nip position NP1 for the conveyance roller pair 21 to nip the recording paper 14. The contact portion 62C is movable in the up-down direction 7 orthogonal to the sheet conveyance direction 6.

As depicted in FIG. 4, each of the end portion contact members 63 provided respectively on the two outer sides of all of the upstream contact members 62 in the width direction 9 has, as with the upstream contact members 62, a base portion 63A, a connection portion 63B, and a contact portion 63C. The contact portion 63C is quadrangular in planar view. The end portion contact member 63 is almost the same as the upstream contact member 62 in the other configurations. The contact portions 63C of the end portion contact members 63 press downward two end portions, in the width direction 9, of the recording paper 14 conveyed by the conveyance roller pair 21.

<Platen>

Figure 5:
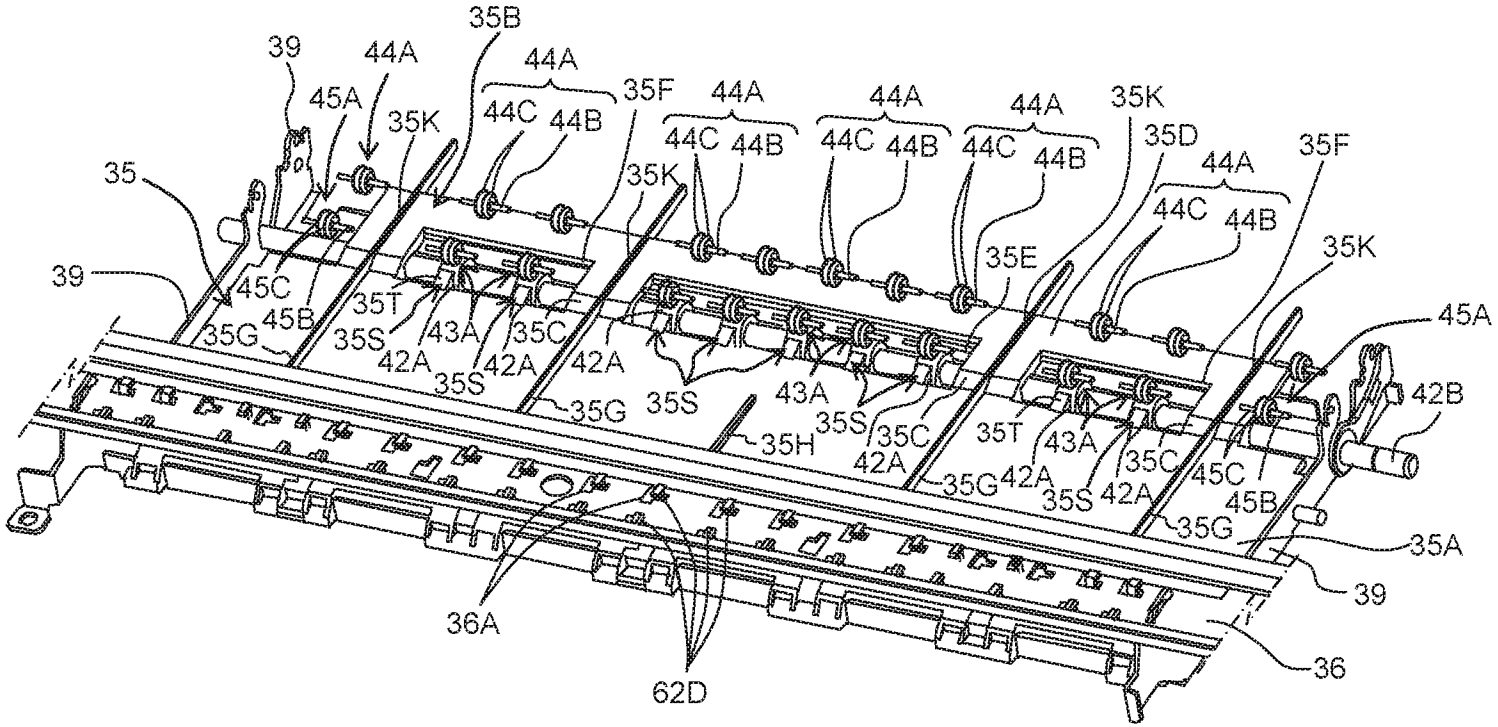
FIG. 5 is a perspective view from an upstream side in the sheet conveyance direction of FIG. 3.

As depicted in FIG. 5, the platen 35 has a platen main body portion 35A positioned below the recording section 31 and a downstream support portion 35B provided in continuity with the downstream end of the platen main body portion 35A in the sheet conveyance direction 6. The platen main body portion 35A is constructed like a flat plate with a constant length along the width direction 9. Each of the two ends of the platen main body portion 35A in the width direction 9 is close to the sub-frame 39.

The downstream support portion 35B is constructed like a band plate along the width direction 9, whose length along the width direction 9 is less than the length of the platen main body portion 35A along the width direction 9. The downstream support portion 35B has first guide portions 35C provided in continuity with the downstream end of the platen main body portion 35A in the sheet conveyance direction 6, and a discharge main body portion 35D provided in continuity with the downstream ends of the first guide portions 35C in the sheet conveyance direction 6.

As depicted in FIG. 7A, each of the first guide portions 35C is provided with a first guide surface 35R extending continuously downstream from the upper surface of the platen main body portion 35A in the sheet conveyance direction 6. The first guide surface 35R is inclined such that the farther downstream in the sheet conveyance direction 6, the shorter in distance from a virtual surface VS1 including the nozzle surface 34A. Therefore, the distance between the discharge main body portion 35D and the virtual surface VS1 including the nozzle surface 34A is shorter than the distance between the platen main body portion 35A and the virtual surface VS1.

As depicted in FIG. 5, the downstream support portion 35B has a central opening portion 35E formed in a central portion in the width direction 9, and lateral opening portions 35F formed at an interval on the two outer sides of the central opening portion 35E in the width direction 9. The central opening portion 35E is formed in a position corresponding to the central wavy shape applying portion 61A on the downstream side of the central wavy shape applying portion 61A of the upstream wavy shape applying mechanism 61 in the sheet conveyance direction 6. The lateral opening portions 35F are formed in positions corresponding respectively to the lateral wavy shape applying portions 61B on the downstream side of the lateral wavy shape applying portions 61B in the sheet conveyance direction 6. The central opening portion 35E and the respective lateral opening portions 35F are positioned between the discharge main body portion 35D and the platen main body portion 35A, and the discharge roller shaft 42B is inserted through lower parts of the central opening portion 35E and lateral opening portions 35F.

As depicted in FIGS. 4 and 5, in the central opening portion 35E, there are positioned upper portions of the five discharge rollers 42A provided on a central portion of the discharge roller shaft 42B in the width direction 9. The five discharge rollers 42A are arranged at constant intervals along the width direction 9. Among the five discharge rollers 42A, the discharge roller 42A positioned in the center in the width direction 9 is provided in a position corresponding to the upstream contact member 62 on the downstream side, in the sheet conveyance direction 6, from the upstream contact member 62 positioned in the center of the central wavy shape applying portion 61A in the width direction 9. Further, among the five discharge rollers 42A, the discharge rollers 42A positioned at the two ends in the width direction 9 are provided respectively in positions corresponding to the respective upstream contact members 62 on the downstream side, in the sheet conveyance direction 6, of the upstream contact members 62 positioned at the two ends of the central wavy shape applying portion 61A in the width direction 9.

As depicted in FIGS. 4 and 5, in each of the lateral opening portions 35F, there are positioned upper positions of the two discharge rollers 42A provided in each of the two end portions of the discharge roller shaft 42B in the width direction 9. The two discharge rollers 42A are provided in positions corresponding respectively to the upstream contact members 62 on the downstream side, in the sheet conveyance direction 6, from the two upstream contact members 62 constituting each of the lateral wavy shape applying portions 61B.

As depicted in FIG. 5, the platen main body portion 35A is provided with second guide portions 35S respectively in upstream positions from the nine discharge rollers 42A in the sheet conveyance direction 6. As depicted in FIG. 6B, each of the second guide portions 35S has a second guide surface 35T extending out continuously downstream from the upper surface of the platen main body portion 35A in the sheet conveyance direction 6. As with the first guide surface 35R of the first guide portion 35C (see FIGS. 7A and 7B), the second guide surface 35T is inclined such that the farther downstream in the sheet conveyance direction 6, the shorter in distance from the virtual surface VS1.

As depicted in FIG. 7A, in each of the first guide portions 35C of the downstream support portion 35B provided at the downstream end of the platen 35 in the sheet conveyance direction 6, an engagement member 35U is provided to engage with the discharge roller shaft 42B. Each of the engagement members 35U has an extend-out portion 35V extending out downward from the upstream end of the first guide portion 35C in the sheet conveyance direction 6, and a contact portion 35W extending out downstream from the lower end of the extend-out portion 35V in the sheet conveyance direction 6. The contact portion 35W is positioned below the discharge roller shaft 42B.

On the lower surface of the discharge main body portion 35D facing the discharge roller shaft 42B, a constraint portion 35X is provided in contact with the discharge roller shaft 42B to constrain the platen 35 from moving. The interval between the constraint portion 35X and the contact portion 35W of the engagement member 35U is greater than the diameter of the discharge roller shaft 42B.

As depicted in FIG. 6A, at the downstream end of the platen main body portion 35A, a plurality of first coil springs 51 are provided respectively and arranged at intervals along the width direction 9. The first coil springs 51 are provided in positions corresponding respectively to the central opening portion 35E and lateral opening portions 35F on the upstream side, in the sheet conveyance direction 6, from the central opening portion 35E and lateral opening portions 35F of the discharge main body portion 35D, to bias the downstream end of the platen main body portion 35A toward the upper side (the virtual surface VS1). As depicted in FIG. 7A, as for the platen 35, when the recording paper 14 is not conveyed, the contact portion 35W of the engagement member 35U is in contact with the discharge roller shaft 42B. By virtue of this, the downstream end of the platen 35 in the sheet conveyance direction 6 is constrained from moving upward and thus positioned.

As depicted in FIG. 6A, at the upstream end of the platen main body portion 35A in the sheet conveyance direction 6, a plurality of spring bearing portions 35Y are provided at intervals in the width direction 9. The spring bearing portions 35Y are arranged in positions corresponding respectively to the first coil springs 51 on the upstream side of the first coil springs 51 in the sheet conveyance direction 6. The spring bearing portions 35Y project toward the upstream side in the sheet conveyance direction 6 in positions farther separate from the virtual surface VS1 than the platen main body portion 35A. Lower portions of the respective spring bearing portions 35Y are in respective engagement with the second coil springs 52 biasing the upstream end of the platen main body portion 35A in the sheet conveyance direction 6 toward the upper side (the virtual surface VS1).

Being biased by the second coil springs 52, the spring bearing portions 35Y are in contact with engagement portions 28A (see FIGS. 6A and 6B) provided in the roller holder 28 for the pinch rollers 26 constituting the conveyance roller pair 21. By virtue of this, the upstream end of the platen 35 in the sheet conveyance direction 6 is constrained from moving upward and thus positioned.

As depicted in FIGS. 4 and 5, in the platen main body portion 35A shaped like a flat plate, one first main rib 35G (one example of the "second contact member") is provided along the sheet conveyance direction 6 between the central wavy shape applying portion 61A and each of the lateral wavy shape applying portions 61B in the width direction 9. These first main ribs 35G project to the upper conveyance path 29 from the upper surface of the platen main body portion 35A. Further, another one first main rib 35G is provided likewise to project to the upper conveyance path 29 between each of the lateral wavy shape applying portions 61B and the corresponding one of the end portion contact members 63. All of the first main ribs 35G have the same configuration and are provided across the entire range of the platen main body portion 35A in the sheet conveyance direction 6 from an upstream end portion of the platen main body portion 35A in the sheet conveyance direction 6.

The downstream support portion 35B of the platen 35 is provided with second main ribs 35K (one example of the "third contact member") arranged along the sheet conveyance direction 6 in respective continuity with the first main ribs 35G of the platen main body portion 35A. The second main ribs 35K are constructed integrally and continuously with the first main ribs 35G to project to the upper conveyance path 29 from the upper surface of the discharge main body portion 35D of the downstream support portion 35B. The projecting ends of the respective first main ribs 35G and second main ribs 35K are positioned in an identical plane. The respective second main ribs 35K extend out further downstream from the downstream end of the downstream support portion 35B in the sheet conveyance direction 6.

When the recording paper 14 is not being conveyed, the platen 35 is biased by the first coil springs 51 and the second coil springs 52, as depicted in FIG. 7A, for the contact portion 35W of the engagement member 35U to contact with the discharge roller shaft 42B. Further, the spring bearing portions 35Y are in contact with the engagement portions 28A of the roller holder 28. By virtue of this, the entire platen 35 including the downstream support portion 35B is positioned closest to the virtual surface VS1. In this case, the first main ribs 35G of the platen main body portion 35A and the second main ribs 35K of the downstream support portion 35B are located respectively in a first position and in a second position which are respectively the shortest in distance from the virtual surface VS1 including the nozzle surface 34A. Further, the same shortest distance is present between each of the first main ribs 35G and second main ribs 35K and the virtual surface VS1.

The platen main body portion 35A is provided with a sub-rib 35H below the central upstream contact member 62 in the central wavy shape applying portion 61A. The sub-rib 35H extends along the sheet conveyance direction 6 and projects upward from the upper surface of the platen main body portion 35A. The projecting end of the sub-rib 35H is farther away from the virtual surface VS1 than the projecting ends of the first main ribs 35G. The downstream end of the sub-rib 35H in the sheet conveyance direction 6 is arranged in a position closer to the downstream support portion 35B than the center of the platen main body portion 35A in the front-rear direction 8.

As depicted in FIG. 6A, in the first position, the projecting ends of the first main ribs 35G are positioned closer to the virtual surface VS1 than the contact part of the contact portion 62C of the upstream contact member 62 for contact with the recording paper 14 when the recording paper 14 is not being conveyed. On this occasion, in the contact portion 62C of the upstream contact member 62 positioned in the center of the upstream wavy shape applying mechanism 61 in the width direction 9, its contact part for contact with the recording paper 14 is in contact with the projecting end of the sub-rib 35H positioned below the contact portion 62C.

If the platen 35 is subjected to a force in an orientation away from the virtual surface VS1, then the platen 35 resists the biasing force of the first coil springs 51 and second coil springs 52 and thus moves in the orientation away from the virtual surface VS1. Therefore, the first main ribs 35G are movable to a third position farther away from the virtual surface VS1 than the first position, while the second main ribs 35K are movable to a fourth position farther away from the virtual surface VS1 than the second position.

<Downstream Wavy Shape Applying Mechanism>

As depicted in FIGS. 6A and 6B, the downstream wavy shape applying mechanism 41 including the plurality of discharge rollers 42A is provided with a spur support member 46 above the discharge rollers 42A to support the first spurs 43A and the second spurs 44A.

Each of the discharge rollers 42A is constructed of an elastic member such as rubber or the like to have a cylindrical shape, and fitted coaxially with the discharge roller shaft 42B. A torque is transmitted from a motor to the discharge roller shaft 42B via an unshown transmission mechanism to rotate the discharge roller shaft 42B in an orientation depicted with the arrow D2 of FIG. 2. By virtue of this, all of the discharge rollers 42A rotate integrally.

As depicted in FIG. 6A, the spur support member 46 has such an upstream end portion in the sheet conveyance direction 6 as positioned above the discharge rollers 42A. Further, as depicted in FIGS. 4 and 5, the spur support member 46 supports the respective first spurs 43A above the respective discharge rollers 42A. Each of the first spurs 43A has two discoid spur portions 43C arranged at an interval in the width direction 9. Each of the spur portions 43C is provided with a concave-convex portion on its outer circumferential surface and along its circumferential direction. A shaft 43B is inserted through a shaft center portion of each of the first spurs 43A along the width direction 9. Each of the shafts 43B is supported to be rotatable by spur support portions 46C (see FIG. 6A) provided along the sheet conveyance direction 6, on the two outer sides of the spur portion 43C in the width direction 9.

As depicted in FIG. 6A, if the recording paper 14 is not being conveyed, then the respective spur portions 43C of the first spurs 43A are in respective contact with the discharge rollers 42A positioned thereunder so as to rotate following the rotations of the respective discharge rollers 42A. The respective spur portions 43C of the first spurs 43A are in contact with the discharge rollers 42A at a nip position NP2 to nip the recording paper 14 being conveyed. The recording paper 14 nipped at the nip position NP2 is conveyed downstream in the sheet conveyance direction 6 by the rotations of the discharge rollers 42A and the spur portions 43C.

The nip position NP2 between the first spurs 43A and the discharge rollers 42A is the same as the position for the contact portions 62C of the respective upstream contact members 62 of the upstream wavy shape applying mechanism 61 to contact with the recording paper 14, in the width direction 9. Further, the nip position NP2 is separate from the virtual surface VS1 by a predetermined distance and its shortest distance from the virtual surface VS1 is the same as the shortest distance between the virtual surface VS1 and the leading ends of the contact portions 62C of the upstream contact members 62 (the contact parts for contact with the recording paper 14).

In the second position, the projecting ends of the second main ribs 35K become closer to the virtual surface VS1 than the nip position NP2 between the first spurs 43A and the discharge rollers 42A. Therefore, the first spurs 43A come to contact with the upper surface of the recording paper 14 from above between the adjacent second main ribs 35K, in the same manner as the contact portions 62C of the upstream contact members 62.

As depicted in FIGS. 4 and 5, one end spur 45A is provided in each of the two outer sides of all the first spurs 43A in the width direction 9. The end spurs 45A also have the same configuration as the first spurs 43A, and each have two spur portions 45C. A shaft 45B extending along the width direction 9 is inserted through a shaft center portion of each of the end spurs 45A. Each of the shafts 45B is also supported to be rotatable by spur support portions (not depicted) provided on the outer sides of the two spur portions 45C in the width direction 9.

The second spurs 44A (one example of the "fourth contact member") are supported in positions corresponding respectively to the first spurs 43A on the downstream side of the respective first spurs 43A in the sheet conveyance direction 6. The respective second spurs 44A have the same configuration as the respective first spurs 43A, and each have two spur portions 44C. A shaft 44B extending along the width direction 9 is inserted through a shaft center portion of each of the second spurs 44A. Each of the shafts 44B is supported to be rotatable by the spur support portions 46C (see FIG. 6A) provided on the outer sides of the two spur portions 44C in the width direction 9.

The lowermost portions of the respective spur portions 44C of the respective second spurs 44A serve as the projecting ends projecting toward the conveyance path 29, and those projecting ends define a fifth position closer to the virtual surface VS1 than the nip position NP2 between the first spurs 43A and the discharge rollers 42A.

<Functions of the Upstream Wavy Shape Applying Mechanism, the Platen, and the Downstream Wavy Shape Applying Mechanism>

In the multifunction peripheral 10 configured as in the above manner, the recording paper 14 of A4 size in the feeding tray 13 is conveyed through the feeding path 15C in the feeding guide member 15 along the guide center, with its longitudinal direction along the sheet conveyance direction 6. Thereafter, the recording paper 14 is nipped by the conveyance roller 22 and the pinch rollers 26 of the conveyance roller pair 21, and conveyed onto the platen 35.

If the recording paper 14 is not being conveyed, then the platen 35 is positioned closest to the virtual surface VS1. Therefore, the first main ribs 35G and the second main ribs 35K are positioned in the first position and the second position which are closest to the virtual surface VS1, respectively.

In the above state, if the recording paper 14 is conveyed to the upstream wavy shape applying mechanism 61, then the leading ends of the respective contact portions 62C and 63C of the seven upstream contact members 62 and the end portion contact members 63 come into contact with the upper surface of the recording paper 14 in the position separate by the distance L1 from the nip position NP1 for the conveyance roller pair 21 to nip the recording paper 14. By virtue of this, the recording paper 14 is pressed downward in an orientation away from the virtual surface VS1 by the respective contact portions 62C and 63C. Further, two end portions of the recording paper 14 in the width direction 9 are pressed downward by the end portion contact members 63, respectively.

Figure 8A:
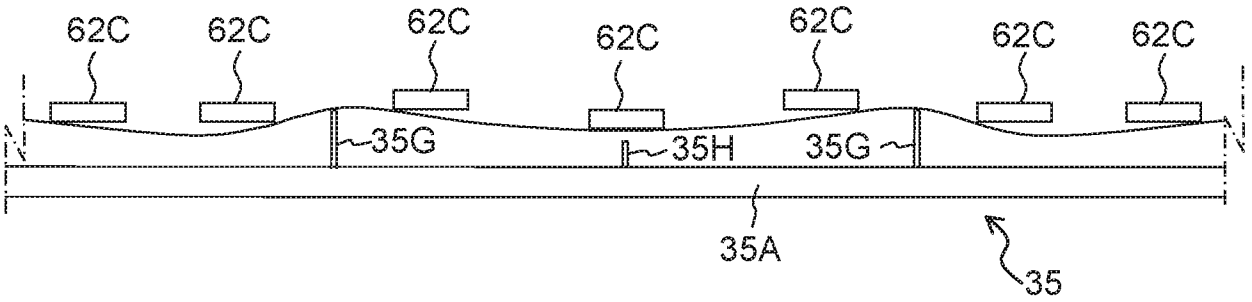
FIGS. 8A and 8B are schematic diagrams for explaining an operation of an upstream wavy shape applying mechanism, respectively.

On this occasion, because the platen main body portion 35A is provided with the first main ribs 35G, as depicted in FIG. 8A, such parts of the recording paper 14 are not pressed downward as in contact with the respective first main ribs 35G, so as to form recesses in the parts in contact with the contact portions 62C between those first main ribs 35G. By virtue of this, a wavy shape extending along the width direction 9 is applied to the recording paper 14.

Further, since the recording section 31 has not yet recorded any image on the recording paper 14 at this point, the recording paper 14 is not swollen because the ink has not yet infiltrated. For this reason, the parts of the recording paper 14 in contact with the contact portions 62C are pressed downward by a comparatively small amount of down-press in correspondence with the rigidity of the recording paper 14. That is, because the recording paper 14 is more rigid in the central portion in the width direction 9 than in the two end portions in the width direction 9, the amount of down-press due to the contact portions 62C of the three upstream contact members 62 constituting the central wavy shape applying portion 61A is smaller than the amount of down-press due to the contact portions 62C of the two upstream contact members 62 respectively constituting each of the lateral wavy shape applying portions 61B.

Further, in the central portion of the recording paper 14 in the width direction 9, the parts raised by the first main ribs 35G are more rigid than the central part in the width direction 9. Hence, among the three upstream contact members 62 constituting the central wavy shape applying portion 61A, the contact portions 62C of the two upstream contact members 62 closer to the respective first main ribs 35G move in the orientation approaching the virtual surface VS1. In such a state, because of the biasing forces of the first coil springs 51 and the second coil springs 52, the platen 35 is hardly pressed downward in the orientation away from the virtual surface VS1.

Figure 8B:
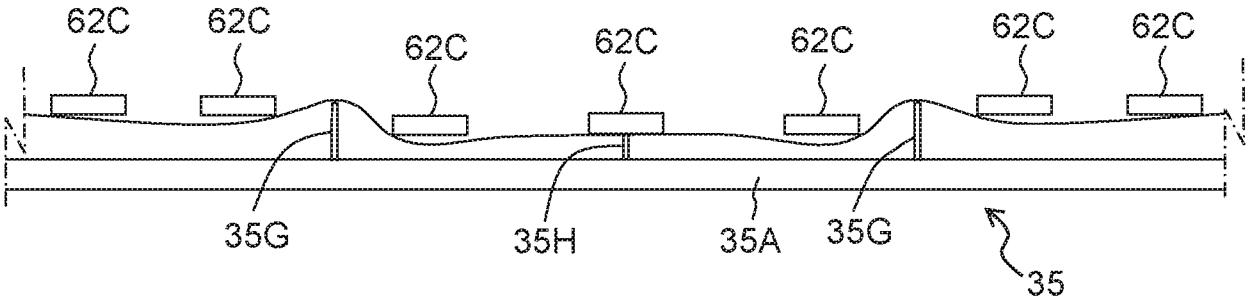

On the recording paper 14 to which the wavy shape extending along the width direction 9 is applied by the upstream wavy shape applying mechanism 61, image is recorded in a predetermined position below the recording section 31. If the image is recorded on the recording paper 14, then the ink has infiltrated to swell the recording paper 14 which thus becomes less rigid, thereby being deformable comparatively easily. On this occasion, the recording paper 14 is less rigid not only in the parts to which the ink adheres but also in the upstream part in the sheet conveyance direction 6, thereby being deformable comparatively easily. Hence, as depicted in FIG. 8B, the upstream wavy shape applying mechanism 61 presses such parts of the recording paper 14 as in contact with the contact portions 62C of the respective upstream contact members 62, down to a position farther away from the virtual surface VS1 than before the image is recorded.

Further, among the three upstream contact members 62 constituting the central wavy shape applying portion 61A, the contact portion 62C of the upstream contact member 62 positioned in the center in the width direction 9 presses down the central portion of the recording paper 14 in the width direction 9 as far as to contact with the upper end of the sub-rib 35H. In contrast to this, the contact portions 62C of the upstream contact members 62 on the two outer sides in the width direction 9 press down the recording paper 14 as far as to a lower position than the upper end of the sub-rib 35H. By virtue of this, the recording paper 14 is made wavy or ruffled along the width direction 9 to have a comparatively largely concave-convex shape.

The recording paper 14 with the image recorded thereon is conveyed onto the downstream support portion 35B with its downstream anterior end in the sheet conveyance direction 6 being guided respectively by the first guide portions 35C and the second guide portions 35S. Having been conveyed on the downstream support portion 35B, the recording paper 14 is conveyed while being nipped at the nip position NP2 between the first spurs 43A and the discharge rollers 42A which are respectively rotating.

On this occasion, together with the discharge rollers 42A, the five first spurs 43A, which are provided in the position corresponding to the central wavy shape applying portion 61A on the downstream side, in the sheet conveyance direction 6, from the central wavy shape applying portion 61A of the upstream wavy shape applying mechanism 61, nip the recess formed in the central portion of the recording paper 14 in the width direction 9.

Further, the first spurs 43A are provided in the positions corresponding respectively to the upstream contact members 62 on the downstream side, in the sheet conveyance direction 6, of the two the upstream contact members 62 constituting each of the lateral wavy shape applying portions 61B. Therefore, the first spurs 43A, together with the discharge rollers 42A respectively thereunder, nip the recording paper 14 respectively at the recesses on the outer sides in the width direction 9.

By virtue of this, the recording paper 14, to which the concave-convex shape extending along the width direction 9 is applied by the upstream wavy shape applying mechanism 61, is maintained in the concave-convex shape also by the downstream wavy shape applying mechanism 41. As a result, on the platen main body portion 35A, even if the ink infiltrates the recording paper 14 to swell part of the recording paper 14, it is still possible to restrain the paper sheet from floating up from the platen (the up-drift phenomenon).

Subsequently, the recording paper 14 is caused to contact with the respective second spurs 44A arranged downstream in the sheet conveyance direction 6 from the nip position NP2 between all the first spurs 43A and the discharge rollers 42A. By virtue of this, it is more possible to maintain the recording paper 14 in the wavy state along the width direction 9 even on the downstream side of the discharge rollers 42A and first spurs 43A in the sheet conveyance direction 6. Thereafter, the recording paper 14 is discharged onto the paper discharge tray 17.

Figure 9:
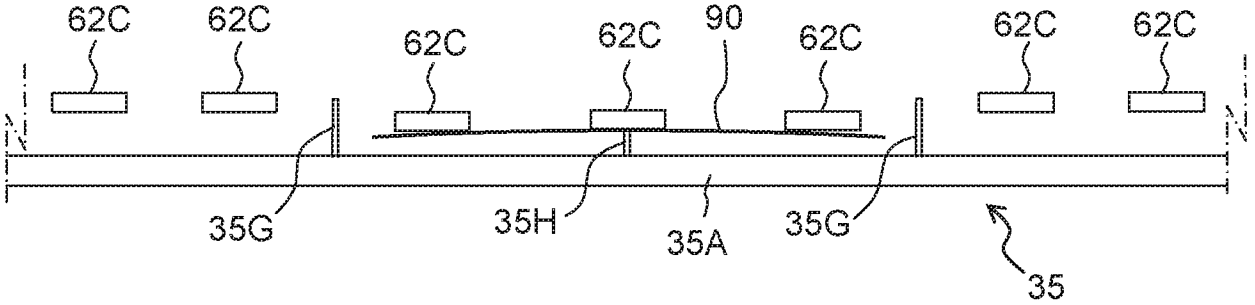
FIG. 9 is a schematic diagram for explaining another operation of the upstream wavy shape applying mechanism when a postcard is conveyed.

Next, an explanation will be made on a case of recording image on a postcard of a smaller size than the recording paper 14 of the A4 size. The postcard is conveyed along the guide center through the feeding path 15C in the feeding guide member 15 with its longitudinal direction being along the sheet conveyance direction 6. Thereafter, the postcard is nipped at the nip position NP1 between the conveyance roller 22 and the pinch rollers 26 of the conveyance roller pair 21, and conveyed onto the platen 35. On this occasion, as depicted in FIG. 9, in the upstream wavy shape applying mechanism 61, the upper surface of the postcard 90 is in contact with the leading ends of the contact portions 62C of the three upstream contact members 62 constituting the central wavy shape applying portion 61A.

On this occasion, a central portion of the postcard 90 in the width direction 9 is in contact with the projecting end of the sub-rib 35H positioned in the central portion of the platen main body portion 35A in the width direction 9. By virtue of this, the contact portion 62C of the corresponding upstream contact member 62 presses down the platen 35 in an orientation away from the virtual surface VS1. As a result, the platen 35 is situated in the state depicted in FIG. 6B and FIG. 7B.

Figure 7B:
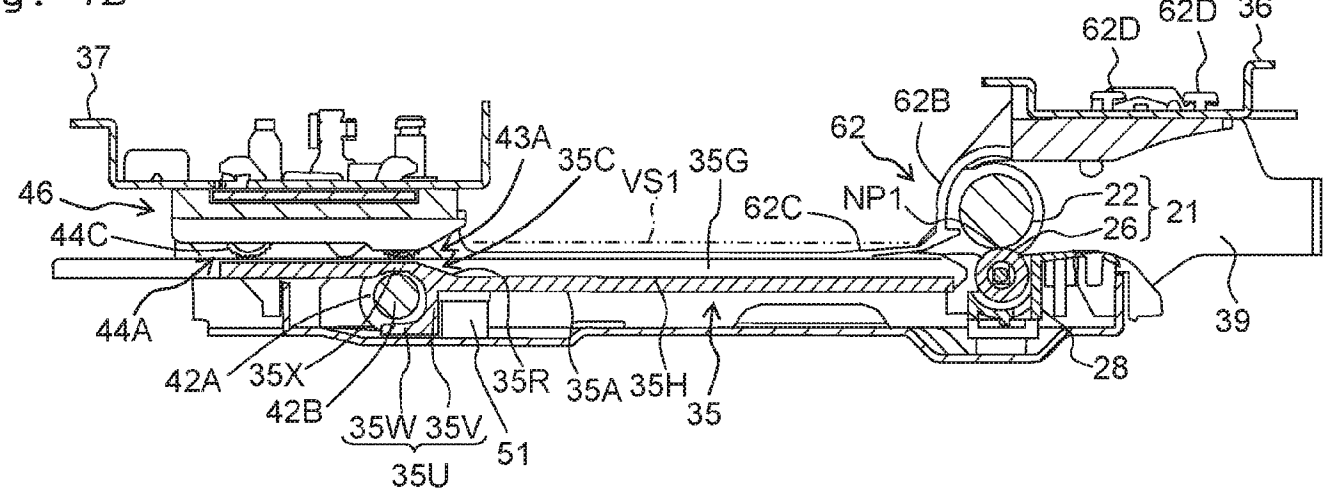
FIG. 7B is an explanatory view of a state of the platen having moved downward in FIG. 7A.

If the platen 35 is pressed downward in the orientation away from the virtual surface VS1, then as depicted in FIG. 7B, the constraint portion 35X provided in the downstream support portion 35B comes to contact with the discharge roller shaft 42B to constrain the platen 35 from moving in the orientation away from the virtual surface VS1. In such a state, the projecting ends of the first main ribs 35G are located in the third position farther away from the virtual surface VS1 than the contact parts of the contact portions 62C of the upstream contact members 62 to contact with the recording paper 14. Further, the projecting ends of the second main ribs 35K provided in the downstream support portion 35B are located in the fourth position farther away from the virtual surface VS1 than the nip position NP2 between the first spurs 43A and the discharge rollers 42A.

In such a state, even though the postcard 90 on the platen main body portion 35A is in contact with the respective contact portions 62C of the three upstream contact members 62 constituting the central wavy shape applying portion 61A, it is still possible to suppress the amplitude of the wavy state along the width direction 9.

Thereafter, on the postcard 90, image is recorded in a predetermined position below the recording section 31. Further, if the postcard 90 undergoes a coating process, then it is prevented from swelling due to the ink infiltration.

On this occasion, the contact portion 62C of the upstream contact member 62 positioned in the central portion in the width direction 9 is in contact with the central portion of the postcard 90 on the sub-rib 35H in the width direction 9, so as to move the platen 35 to a position away from the virtual surface VS1. Therefore, that contact portion 62C has a smaller pressing force than in the case of the postcard 90 being laid on the first main ribs 35G. By virtue of this, the pressure on the postcard 90 is reduced by the contact portion 62C and the sub-rib 35H such that the postcard 90 is conveyed smoothly.

The postcard 90 with the image recorded thereon is conveyed onto the downstream support portion 35B. The postcard 90 conveyed on the downstream support portion 35B is conveyed while being nipped at the nip position NP2 between the first spurs 43A and the discharge rollers 42A which are rotating. Thereafter, while the postcard 90 is in contact with the second spurs 44A, the postcard 90 is discharged onto the paper discharge tray 17 without being ruffled.

Function and Effect of the Embodiment

In the above embodiment, the nip position NP2 between the first spurs 43A and the discharge rollers 42A is set to be such a position as to correspond to the respective contact portions 62C on the downstream side, in the sheet conveyance direction 6, from the contact parts of the contact portions 62C of the upstream contact members 62 to contact with the sheet. Further, the shortest distance between the nip position NP2 and the virtual surface VS1 is the same as the shortest distance between the contact parts and the virtual surface VS1. By virtue of this, there is a stable distance in the sheet conveyance direction 6 between the recording paper 14 on the platen 35 and the virtual surface VS1 including the nozzle surface 34A. Further, the upstream contact members 62 are supported by the first guide frame 36 while the discharge rollers 42A are supported by the sub-frame 39. Then, the first guide frame 36 is also supported by the sub-frame 39. Therefore, it is possible to realize an accurate positioning between the contact parts of the contact portions 62C of the upstream contact members 62 to contact with the recording paper 14, and the nip position NP2 between the first spurs 43A and the discharge rollers 42A.

Further, because both the plurality of upstream contact members 62 and the plurality of discharge rollers 42A are arranged at intervals separating each other in the width direction 9, conveying the recording paper 14 is stabilized.

Further, the projecting ends of the first main ribs 35G projecting toward the conveyance path 29 are located in the first position closer to the virtual surface VS1 than the contact parts of the contact portions 62C of the upstream contact members 62 to contact with the recording paper 14. Further, the projecting ends of the second main ribs 35K projecting toward the conveyance path 29 are located in the second position closer to the virtual surface VS1 than the nip position NP2 between the first spurs 43A and the discharge rollers 42A.

By virtue of this, with the plurality of upstream contact members 62 and the first main ribs 35G, it is possible to ruffle the recording paper 14 on the upstream side of the nozzles 34 of the recording section 31 in the sheet conveyance direction 6. Further, with the plurality of discharge rollers 42A, the first spurs 43A and the second main ribs 35K, it is possible to ruffle the recording paper 14 also on the downstream side of the nozzles 34 of the recording section 31 in the sheet conveyance direction 6.

The projecting ends of the first main ribs 35G are movable between the first position and the third position farther away from the virtual surface VS1 than the first position, while the projecting ends of the second main ribs 35K are movable between the second position and the fourth position farther away from the virtual surface VS1 than the second position. By virtue of this, when conveying a sheet onto the platen 35 such as the postcard 90 or the like which has a high rigidity and thus is less necessary to be ruffled, the platen moves according to the sheet rigidity. Therefore, it is possible to suppress the amplitude of the ruffled state of the sheet.

The projecting ends of the first main ribs 35G in the third position are farther away from the virtual surface VS1 than the contact parts of the contact portions 62C of the upstream contact members 62 to contact with the sheet, while the projecting ends of the second main ribs 35K in the fourth position are farther away from the virtual surface VS1 than the nip position NP2 between the first spurs 43A and the first spurs 43A. By virtue of this, it is possible to further restrain the sheet of high rigidity from being ruffled.

Along with motion of the platen 35, the first main ribs 35G are movable between the first position and the third position, while along with motion of the platen 35, the second main ribs 35K are movable between the second position and the fourth position. By virtue of this, it is possible to easily realize the provision of the first main ribs 35G and the second main ribs 35K. Further, along with motion of the platen 35, the first main ribs 35G and second main ribs 35K are movable integrally.

The first main ribs 35G and the second main ribs 35K are formed continuously along the sheet conveyance direction 6. By virtue of this, it is also possible to easily realize the provision of the first main ribs 35G and the second main ribs 35K.

The plurality of second spurs 44A are arranged respectively on the downstream side of the second main ribs 35K in the sheet conveyance direction 6 and in the same position as the second main ribs 35K in the width direction 9. Then, the projecting ends of the second spurs 44A projecting toward the conveyance path 29 are closer to the virtual surface VS1 than the nip position NP2 between the first spurs 43A and the discharge rollers 42A. By virtue of this, it is easy to maintain the recording paper 14 in the ruffled state on the downstream side of the discharge rollers 42A and first spurs 43A in the sheet conveyance direction 6.

The recording section 31 includes the carriage 32 which is supported by the first guide frame 36 and is movable in the width direction 9 intersecting the sheet conveyance direction 6 and being parallel to the nozzle surface 34A, and the recording head 33 being mounted on the carriage 32 and having the nozzles 34. By virtue of this, it is easy to position the upstream contact members 62 and the like with respect to the nozzles 34.

Modification

As depicted in FIG. 6A with the imaginary line, it may be configured to provide a revolving shaft 35Z extending along the width direction 9 at the downstream ends of the second main ribs 35K of the platen 35, and support the revolving shaft 35Z to be revolvable on the sub-frame 39. By virtue of this, the platen 35 becomes revolvable about the revolving shaft 35Z such that it is possible to move the platen 35 in the same orientation with respect to the recording section 31 on both the upstream side and the downstream side in the sheet conveyance direction 6.

Other Modifications

Further, it is not necessary to provide a plurality of upstream contact members 62 and a plurality of discharge rollers 42A but they may be provided each as a single member, respectively.

The platen 35 is movable in the up-down direction so as to allow for applying an appropriate wavy shape to the sheet in accordance with the rigidity and the like of the sheet. However, the platen 35 may be configured not to move in the up-down direction. In such cases, a pressing force of the respective upstream contact members 62 applies the wavy shape to the sheet in accordance with the rigidity and the like of the sheet. Further, the platen 35 may be configured independently from the respective first main ribs 35G and second main ribs 35K. Further, the platen 35 may be provided with the respective first main ribs 35G and second main ribs 35K which are discontinuous.

What is claimed is:

1. An ink-jet recording apparatus comprising:

a conveyance roller pair configured to convey a sheet guided through a conveyance path in a conveyance direction;

a recording section having a nozzle surface provided with nozzles and configured to jet ink droplets from the nozzles and to record an image on the sheet conveyed by the conveyance roller pair;

a platen arranged to face the recording section;

a first support frame configured to support the recording section;

a first contact member supported by the first support frame, arranged upstream of the nozzles in the conveyance direction, extended toward the platen, and configured to contact with the sheet;

a discharge roller arranged downstream of the nozzles in the conveyance direction;

a second support frame configured to support the discharge roller; and a spur arranged to face the discharge roller and configured to contact with the sheet from the same direction as the first contact member, wherein the first support frame is supported by the second support frame, and a contact part, at which the first contact member contacts with the sheet, and a nip position, at which the discharge roller and the spur nip the sheet, are located at the same position in a width direction intersecting the conveyance direction and being parallel to the nozzle surface, and have the same shortest distance from a virtual surface including the nozzle surface.

2. The ink-jet recording apparatus according to claim 1, wherein the first contact member is included in a plurality of first contact members arranged to be apart from each other in the width direction, and the discharge roller is included in a plurality of discharge rollers arranged to be apart from each other in the width direction.

3. The ink-jet recording apparatus according to claim 2, further comprising:

a second contact member arranged between contact parts of an adjacent pair of first contact members of the plurality of first contact members in the width direction, and located at a first position at which projecting end thereof projecting toward the conveyance path is closer to the virtual surface than the contact parts; and a third contact member arranged between an adjacent pair of discharge rollers of the plurality of discharge rollers in the width direction, and located at a second position at which projecting end thereof projecting toward the conveyance path is closer to the virtual surface than the nip position.

4. The ink-jet recording apparatus according to claim 3, wherein the second contact member is movable between the first position and a third position at which the projecting end thereof is farther from the virtual surface as compared to the first position, and the third contact member is movable between the second position and a fourth position at which the projecting end thereof is farther from the virtual surface as compared to the second position.

5. The ink-jet recording apparatus according to claim 4, wherein at the third position, the projecting end of the second contact member is farther from the virtual surface than the contact parts of the adjacent pair of first contact members, and at the fourth position, the projecting end of the third contact member is farther from the virtual surface than the nip position.

6. The ink-jet recording apparatus according to claim 4, wherein the second contact member and the third contact member are provided on the platen, the platen is movable in a direction orthogonal to both the conveyance direction and the width direction, the second contact member is movable between the first position and the third position along with movement of the platen, and the third contact member is movable between the second position and the fourth position along with the movement of the platen.

7. The ink-jet recording apparatus according to claim 6, wherein the platen is rotatable about one end thereof which is located downstream in the conveyance direction.

8. The ink-jet recording apparatus according to claim 3, wherein the second contact member and the third contact member are formed continuously along the conveyance direction.

9. The ink-jet recording apparatus according to claim 3, further comprising a fourth contact member arranged at a fifth position which is the same position as the third contact member in the width direction, which is downstream of the third contact member in the conveyance direction, and at which projecting end thereof projecting toward the conveyance path is closer to the virtual surface than the nip position.

10. The ink-jet recording apparatus according to claim 1, wherein the recording section comprises:

a carriage supported by the first support frame to be movable in the width direction; and a recording head mounted on the carriage and having the nozzles.

* * * * *